United States Patent [19]

Jones

[11] Patent Number: 4,867,788

[45] Date of Patent: Sep. 19, 1989

[54] POWDER METALLURGY PROCESS

[75] Inventor: Andrew R. Jones, Preston, United Kingdom

[73] Assignee: United Kingdom Atomic Energy Authority, London, United Kingdom

[21] Appl. No.: 249,299

[22] Filed: Sep. 26, 1988

[30] Foreign Application Priority Data

Oct. 12, 1987 [GB] United Kingdom ..... 8723915

[51] Int. Cl.[4] ..... C22C 29/00

[52] U.S. Cl. ..... 75/230; 75/235; 148/126.1; 419/29; 419/48; 419/49

[58] Field of Search ..... 419/48, 49, 29; 75/230, 75/235; 148/126.1

[56] References Cited

U.S. PATENT DOCUMENTS 4,443,949 4/1984 Weber et al. ..... 148/11.5 P
4,732,622 3/1988 Jones ..... 148/126.1

FOREIGN PATENT DOCUMENTS

WO85/03463 8/1985 World Int. Prop. O. .

*Primary Examiner*—Stephen J. Lechert, Jr.
*Attorney, Agent, or Firm*—William R. Hinds

[57] ABSTRACT

To control grain size during recrystallization annealing of a consolidated metallurgical, dispersion-strengthened powder allow material, the initial powder is seeded with a powder alloy in which the dispersoid is absent or is in a coarser form or is present in a lesser quantity so that the seeds provide sites at which nucleation of recrystallization is promoted.

9 Claims, No Drawings

POWDER METALLURGY PROCESS

This invention relates to the production of powder metallurgy products by consolidating metal alloy powder particles. It is known to include within the alloy composition constituents which, in the consolidated product, form fine refractory dispersoid particles distributed throughout the matrix to confer properties such as high strength and creep resistance at elevated temperatures, eg of the order of 650° C. as encountered for example in liquid metal cooled fast fission nuclear reactors.

The refractory dispersoid constituent may be for example an oxide such as yttria or a nitride such as titanium nitride. The dispersoid may be present as such in the initial powder charge prior to consolidation or the powder particles may incorporate precursors of the desired dispersoid as disclosed in for example our prior published European patent application No. 225047 in which titanium nitride may be the dispersoid and is produced by the high temperature interaction of elemental titanium with nitrogen donated as a result of dissociation of chromium nitride, the elemental titanium and chromium nitride initially being incorporated, as separate constituents, with the other constituents of the alloy by a mechanical alloying process.

One problem encountered, particularly in the case of oxide dispersion strengthened alloys for use as fast fission reactor fuel cladding, is achieving grain sizes of the desired dimensions, ie 20–40 microns (measurements being made using the mean linear intercept method). These grain sizes require to be produced by recrystallisation annealing during or towards the end of product processing. However, the fine dispersoid particles (typically 0.03–0.05 microns in diameter) which impart creep strength, interfere with both nucleation and growth of grains during recrystallisation and can make the kinetics of recrystallisation and grain size control within desired bounds extremely difficult. The grain size which results from recrystallisation is dominated by the density of viable recrystallisation muclei. In the case of fast reactor cladding referred to above, it is believed that the fine dispersoid can lead to very coarse grain structures by limiting nucleation of recrystallisation.

According to the present invention there is provided a method of manufacturing powder metallurgy products in which, to control grain size:

(i) a first metal alloy powder incorporating a refractory dispersoid material (or a precursor thereof) is intimately combined with a substantially lesser quantity of a second metal alloy powder in which the refractory dispersoid material content is (a) entirely absent or (b) present but in a lesser amount or (c) present as coarser particles;

(ii) the combined powders are consolidated; and (iii) the dispersoid-containing consolidated product is subjected to recrystallisation annealing in which the particles of the second alloy powder stimulate nucleation of recrystallisation.

It is already known from GB Pat. No. 2048955 to produce powder metallurgical products by a route in which two batches of the same titanium-containing powder, one of which has been nitrided, are blended in proportions to give an overall nitrogen content equal to that required for stoichiometric titanium nitride which functions as a dispersoid in the final product. In this instance, the quantity of un-nitrided powder in the blend will necessarily by many times that of the nitrided powder to meet the requirement for stoichiometric titanium nitride. This is in contrast with the present invention where it is the dispersoid-containing powder that predominates in the initial blend.

Where the method of the invention is carried out initially using a dispersoid precursor rather than the dispersoid per se, a donor (eg chromium nitride where a refractory nitride dispersoid is to be produced) will also be incorporated in the first metal alloy powder (and the second powder if this is to contain dispersoid) and prior to consolidation the first metal powder or both powders (either separately or after they have been combined) may be heated to effect dissociation of the donor so that formation of the refractory dispersoid is achieved in the first powder or both powders. Alternatively, dissociation may be effected in the course of the consolidation step.

The metal powders are conveniently produced by atomisation, with the dispersoid or dispersoid precursor subsequently distributed by mechanical alloying—see Metals Handbook, 9th Edition, Volume 7, pages 722–727 for a description of mechanical alloying. The two metal powders may have substantially identical constituents and amounts thereof apart from the dispersoid (or precursor) constituent. The alloy compositions may be iron-based, eg ferritic steels. In one application of the invention, the alloy composition of the first powder may be a ferritic steel having the composition 14Cr: 1Ti: 0.3Mo: 0.25$Y_2O_3$: balance Fe and the second powder may have substantially the same composition except for the yttria content which may be less or entirely absent.

The consolidation step may comprise hot extrusion in which the combined powders are, in known manner, sealed in a can (of mild steel usually) and extruded together with the can at a temperature of the order of 1065° C. A recrystallisation anneal may be carried out prior to removal of the can to reduce the risk of oxidation and may be carried out at a temperature higher than that at which consolidation is effected.

Alternatively, the consolidation step may be performed by hot isostatic pressing of the combined metal powders.

The invention is based on the recognition that in dispersion-strengthened alloys, fine dispersoid particles tend to impede both the kinetics of nucleation of recrystallisation and the eventual number density of viable nuclei formed. The invention seeks to overcome this problem by providing an appropriate density of sites at which nucleation of recrystallisation is promoted. In one approach, such nucleating sites are provided by seeding the matrix with dispersoid-free particles. For example, if an eventual grain size of the order of 30 microns is required, the dispersoid free volume per final grain may require to be 5 microns in diameter to allow formation of at least one viable nucleus for recrystallisation. Since only one nucleus is required in each grain, it follows that a volume fraction of only 0.5–1.0% of appropriately sized dispersoid free 'seed' particles may accomplish the required recrystallisation behaviour. Additions of higher volume fractions of 'seed' powder may further refine the final grain size. It is envisaged that the only practical limitation to the volume fraction of 'seed' powder which may be added is that it should not produce undesirable strength reduction of the consolidated end product.

Although it is presently considered preferable for the second metal powder particles used to seed the matrix to be dispersoid free, it is considered feasible for such seed particles to contain dispersoid material but in a lesser amount so that, in terms of promoting nucleation of recrystallisation, the "seed" zones are subject to a reduced constraint by the lesser amount of dispersoid particles (which will have greater interparticle distances than in the remaining matrix of the consolidated product).

Also, because it is well established that above a certain size (which tends to be alloy specific) dispersoid particles can themselves act as centres for the promotion of nucleation of recrystallisation (by virtue of enhancing local stored energy of cold work) it is envisaged that the second metal powder may have a significant content of dispersoid material (even as much as or, conceivably more than, the first metal powder particles) if the dispersoid content in the second metal powder is in the form of coarse particles. Typically for an iron based alloy these coarse dispersoid particles might have diameters of 0.3–0.5 microns or larger and can be present in number densities the only limitation on which would be that they should not be high enough to cause the inter-dispersoid spacing to fall below a distance typically of the order of 0.8–1.0 microns.

As the principal role of the second metal powder is to provide sites for the nucleation of recrystallisation within the matrix formed by the first metal powder following consolidation, it will be appreciated that in the first instance the proportion of the second metal powder employed need only be a small fraction of the first metal powder content, eg less than 5–10% by weight.

I claim:

1. A method of manufacturing powder metallurgy products to control grain size wherein:

(i) a first metal alloy powder incorporating a refractory dispersoid material (or a precursor thereof) is intimately combined with a substantially lesser quantity of a second metal alloy powder in which the refractory dispersoid material content is (a) entirely absent or (b) present but in a lesser amount or (c) present as coarser particles;

(ii) the combined powders are consolidated; and (iii) the dispersoid-containing consolidated product is subjected to recrystallisation annealing in which the particles of the second alloy powder stimulate nucleation of recrystallisation.

2. A method as claimed in claim 1, wherein apart from the dispersoid or precursor constituent, the two metal powders have substantially identical constituents and amounts thereof.

3. A method as claimed in claim 1, wherein the alloy compositions are iron-based.

4. A method as claimed in claim 2, wherein the alloy composition of the first powder is a ferritic steel having the composition 14Cr: 1Ti: 0.3Mo: $0.25Y_2O_3$: balance Fe, and the second powder has substantially the same composition except for the yttria content which is present in a lesser amount or entirely absent.

5. A method as claimed in claim 1, wherein the consolidation step comprises hot extrusion in which the combined powders are sealed in a can and extruded together with the can.

6. A method as claimed in claim 1, wherein the consolidation step is performed by hot isostatic pressing of the combined metal powders.

7. A method as claimed in claim 1, wherein the proportion of said second metal powder is less than 10% by weight.

8. A method as claimed in claim 1, wherein the proportion of said second metal powder is less than 5% by weight.

9. A powder metallurgy product produced by the method of claim 1.

* * * * *